US008713894B2

(12) United States Patent
Viereck et al.

(10) Patent No.: US 8,713,894 B2
(45) Date of Patent: May 6, 2014

(54) SYSTEM AND METHOD FOR BARRIER CABLE EMBED ALIGNMENT

(76) Inventors: Kyle Viereck, Spring, TX (US); Russell L. Price, Magnolia, TX (US)

( * ) Notice: Subject to any disclaimer, the term of this patent is extended or adjusted under 35 U.S.C. 154(b) by 8 days.

(21) Appl. No.: 13/480,707

(22) Filed: May 25, 2012

(65) Prior Publication Data

US 2012/0297728 A1 Nov. 29, 2012

Related U.S. Application Data

(60) Provisional application No. 61/489,801, filed on May 25, 2011.

(51) Int. Cl.
*E04G 15/04* (2006.01)

(52) U.S. Cl.
USPC ..... 52/745.21; 52/742.14; 52/396.04; 249/83; 264/35; 264/333

(58) Field of Classification Search
CPC ..... E04B 1/38; E04C 2/28; E04C 2/02; E04C 2/04; E04C 2/08; E04C 2003/043; E01F 13/12; E01F 15/083; E01F 15/00; E01F 13/00; E04H 17/16; E04G 15/04; E04G 21/185; E04G 23/02; E01D 2101/26
USPC ..... 52/742.1, 742.12, 742.13, 742.14, 52/742.15, 745.21, 127.1, 127.2, 294, 295, 52/299, 393, 396.04, 396.05, 396.07, 52/396.08; 404/6, 45; 256/13.1, 73; 249/1–5, 13, 18, 48, 50–51, 83, 85, 96; 425/123, 111; 264/35, 228, 229, 261
See application file for complete search history.

(56) References Cited

U.S. PATENT DOCUMENTS

| | | | | |
|---|---|---|---|---|
| 2,636,426 | A * | 4/1953 | Heltzel et al. | 249/9 |
| 4,075,473 | A * | 2/1978 | Winston | 256/13.1 |
| 6,108,910 | A | 8/2000 | Sorkin | |
| 6,918,567 | B2 * | 7/2005 | Ward et al. | 249/4 |
| 8,083,433 | B2 * | 12/2011 | Neusch | 404/6 |
| 2004/0093824 | A1 * | 5/2004 | Huber et al. | 52/721.4 |
| 2007/0284562 | A1 * | 12/2007 | Bunk et al. | 256/10 |
| 2011/0062403 | A1 * | 3/2011 | Neusch | 256/13.1 |
| 2013/0000245 | A1 * | 1/2013 | Tarr | 52/745.21 |
| 2013/0008111 | A1 * | 1/2013 | Wu et al. | 52/309.17 |

* cited by examiner

*Primary Examiner* — Brian Glessner
*Assistant Examiner* — Beth Stephan
(74) *Attorney, Agent, or Firm* — Ober, Kaler, Grimes & Shriver; Royal W. Craig

(57) ABSTRACT

A method and apparatus for barrier cable anchorage in a concrete formwork such that individual anchors are positioned relative to each other and to the formwork. A galvanized plate is provided with series of holes spaced from a reference point at the plate edge, and a registered assembly of individual anchors are provided in the holes. Female threaded plate caps are secured within the holes for frontal engagement, and a PSR stud is secured to each plate cap on the back side. The assembly is frontally set against the formwork with the reference point spaced from an external datum. The formwork is cured and barrier cables are affixed to the plate caps through the plate by threaded engagement with a barrel anchor and wedge. After tensioning, each cable is anchored to the formwork in desired relative proximity to one another and to the external datum.

8 Claims, 5 Drawing Sheets

SYSTEM AND METHOD FOR BARRIER CABLE EMBED ALIGNMENT

CROSS-REFERENCE TO RELATED APPLICATIONS

The present application derives priority from U.S. Provisional Patent Application Ser. No. 61/489,801 filed May 25, 2011.

BACKGROUND OF THE INVENTION

1. Field of the Invention

The present invention relates generally to barrier cable anchorage systems and, more particularly, to a system and method for ensuring proper barrier cable anchorage positioning.

2. Description of the Background

Building codes require parking structures, like all structures, to provide fall protection for occupants where vertical drops between ramps or elsewhere within the space exceed an allowable minimum, typically 12 or 30 inches. Fall protection in garage structures commonly takes the form of a barrier system such as a railing located along exterior structure edges as well as at the edges of the numerous interior ramps and grade changes within the structure that allow vehicles to access the space. Fall protection barriers provided only for pedestrian safety are not expected to experience high loading conditions and can thus be relatively lightweight. Significantly greater loads are anticipated in areas of vehicular traffic and barrier system must be engineered to resist those loads.

Acceptable vehicular barrier systems can be provided by reinforced concrete or masonry walls, although these systems are relatively expensive and heavy. The added weight may impact the overall design of the structure itself. Steel cable barrier systems are lighter, provide visibility inside the structure for vehicle safety, and are less expensive and are consequently perhaps the most commonly used vehicular and pedestrian barrier system in parking structures. Barrier cable systems typically use ½ inch diameter, 7-wire steel strands that are galvanized for corrosion resistance, and sometimes plastic (polyethylene) or epoxy coated for aesthetic reasons. Barrier cable systems designed for passenger car vehicular traffic, and indeed passenger vehicle barriers of all types, must be designed to resist a single 6,000 pound load applied horizontally in any direction. For design purposes, the load is presumed to be applied at a minimum height of 18 inches above the finished floor surface over an area not exceeding one square foot and cable deflection under load should not exceed 18-inches. Multiple steel barrier cables are readily able to handle such loads. Consequently, failure of a cable barrier system is most likely to occur at the cable anchorages or at the connection between the anchorages and the supporting structure, typically the concrete columns or other elements of the garage structure.

A variety of surface mounted and embedded methods are used to anchor the cable ends to the concrete structure of the garage. In a typical anchorage assembly, each cable of the barrier passes through the column and into a pocket on the opposite side in which an embedded wedge type anchor was situated before the column was cast. The cable passes through the conically tapered barrel of the anchor into which a series of wedges are positioned around the cable. As the cable is tensioned by pulling it through the column using a tensioning jack, the cable elongates and the wedges permit the cable to pass though the barrel. However, when the tensioning jack is released the cable recoils and the wedges clamp down on the cable as it is drawn into the tapered barrel, thereby maintaining cable tension. The cable may be anchored in this manner where access to the opposite side of one or both of the end columns is accessible. Where no access is available to the opposite side of a column the cable may be anchored at one end at the face of the column and tensioned at the other end as described. With reference to FIGS. 1 and 2, face anchoring of cables where backside access is limited may be accomplished by individually placing a female threaded ferrule loop insert within the column formwork for each cable. A temporary bolt may be inserted into the threaded loop insert to protect the threads. After the concrete has cured the temporary bolt is removed and a cooperatively threaded male cable connector is advanced into the female insert. The male "Fixed-End Grabb-It®" type connector uses a conical barrel and wedge system to anchor the cable as illustrated and described above. Similarly, if there is no access to the opposite side of both end columns, a face mounted solution can be utilized at both locations where one end used a "Fixed-End Grabb-It®" and the opposite end uses a "Stress-End Grabb-It®"

With both through and face anchored cables, it is necessary to accurately and securely position the anchorage for each of the barrier cables before pouring the concrete structure because, even though vehicular loading governs most aspect of barrier design, pedestrian barrier cable spacing is dictated by building codes that limit the size of any opening through the barrier for the protection of children. Cable openings are limited to being smaller than will allow a four inch sphere to pass through. In practice this typically means that cables are placed on 4-inch centers such that the space between would be 3½-inches. Accurately positioning individual anchors within the concrete formwork for each of the cable strands needed to meet the 42-inch minimum pedestrian barrier height on 4-inch centers is critical and consequently time consuming and costly. Even a slight misalignment of an anchor can result in the barrier cable failing to meet the maximum space limitation of the building code and requiring additional, costly remedial work by the contractor to correct the error after the concrete structure has been erected.

SUMMARY OF THE INVENTION

It is, therefore, a primary object of the present invention to accurately position multiple cable anchorage locations within a concrete formwork.

It is another object of the invention to permit placement of multiple cable anchors by a single embedded element.

It is yet another object of the invention to provide an embedded anchorage that withstands pullout forces to the full breaking strength of the barrier cable.

In accordance with the foregoing objects, the present invention is a method of and apparatus for aligning individual barrier cable anchorage locations within a concrete formwork so as to result in individual barrier cable anchors which are embedded in and secured to the concrete structure in a desired relative proximity to each other and the structure itself. The method is performed by providing a registered assembly of said individual anchorage locations constructed of a typically galvanized plate member defined by a series of holes from front to back in a predetermined relative proximity, the desired relative proximity also being relative to a reference point at an edge of the plate member. Female threaded plate caps are secured within the holes so as to be operatively engaged from the front side of the plate. A punching shear resistor (PSR) stud is secured to each of the plate caps on said back side of said plate. The entire assembly is set within a concrete formwork with the front side of the plate engaged to the surface of the form and the edge reference point positioned in a relative proximity to an external datum (geodesy), a standard position or level that measurements are taken from such as an elevation within the building structure. After the concrete is placed and cured and the forms removed, barrier cables are affixed to each plate cap through the plate member by cooperative engagement with a barrel anchor and wedge, the barrel anchor being further externally threaded for engagement with each plate cap. After tensioning, each cable is anchored to the concrete structure in the desired relative proximity to one another and to the external datum.

The method and apparatus permits placement of multiple cable anchors by a single embedded element, and aligns the individual barrier cable anchors within the concrete structure so as to be embedded in and secured in desired relative proximity and securely, capable of withstanding pullout forces to the full breaking strength of the barrier cable.

BRIEF DESCRIPTION OF THE DRAWINGS

Other objects, features, and advantages of the present invention will become more apparent from the following detailed description of the preferred embodiments and certain modifications thereof when taken together with the accompanying drawings in which.

DETAILED DESCRIPTION OF THE PREFERRED EMBODIMENT

The present invention is a single-piece multi-cable barrier anchorage embed system 1 and complimentary method of use for securely and accurately positioning multiple barrier cable anchorages within a concrete formwork and thereafter anchoring multiple barrier cables to act as a vehicular and pedestrian barrier.

Figure 2:
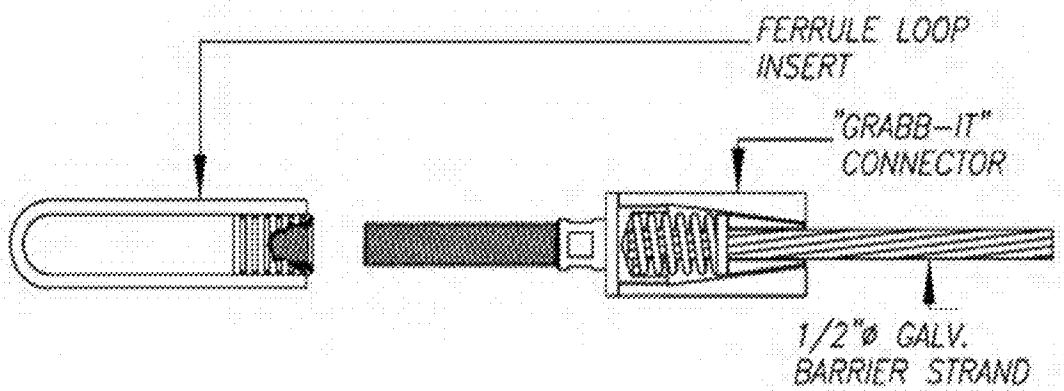
FIG. 2 (Prior Art)
FIG. 2 is a detail view of a prior art method of anchoring cables.
Figure 1:
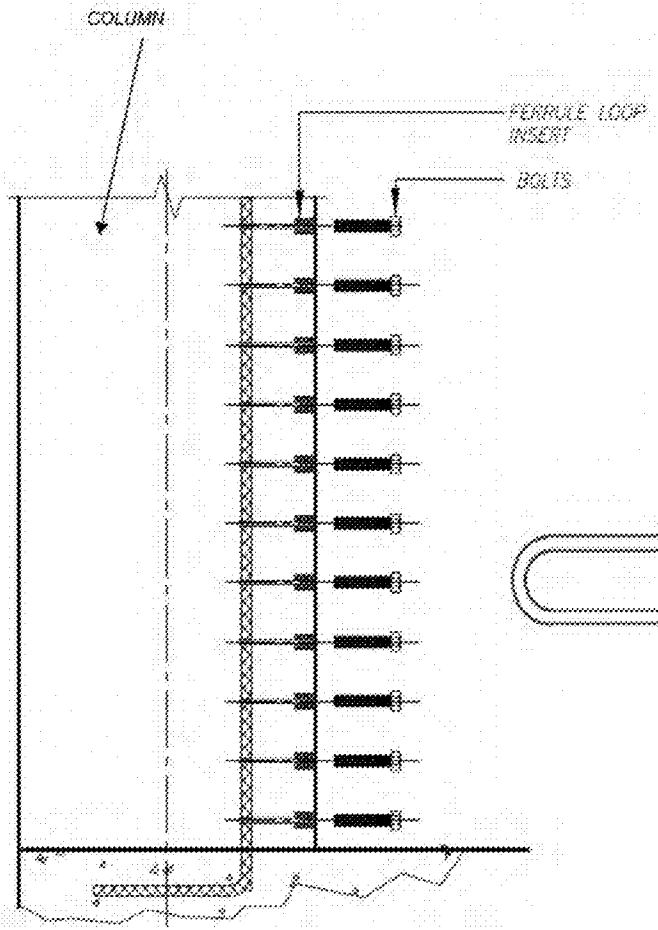
FIG. 1 (Prior Art)
FIG. 1 is section of a prior art method of anchoring cables.
Figure 3:
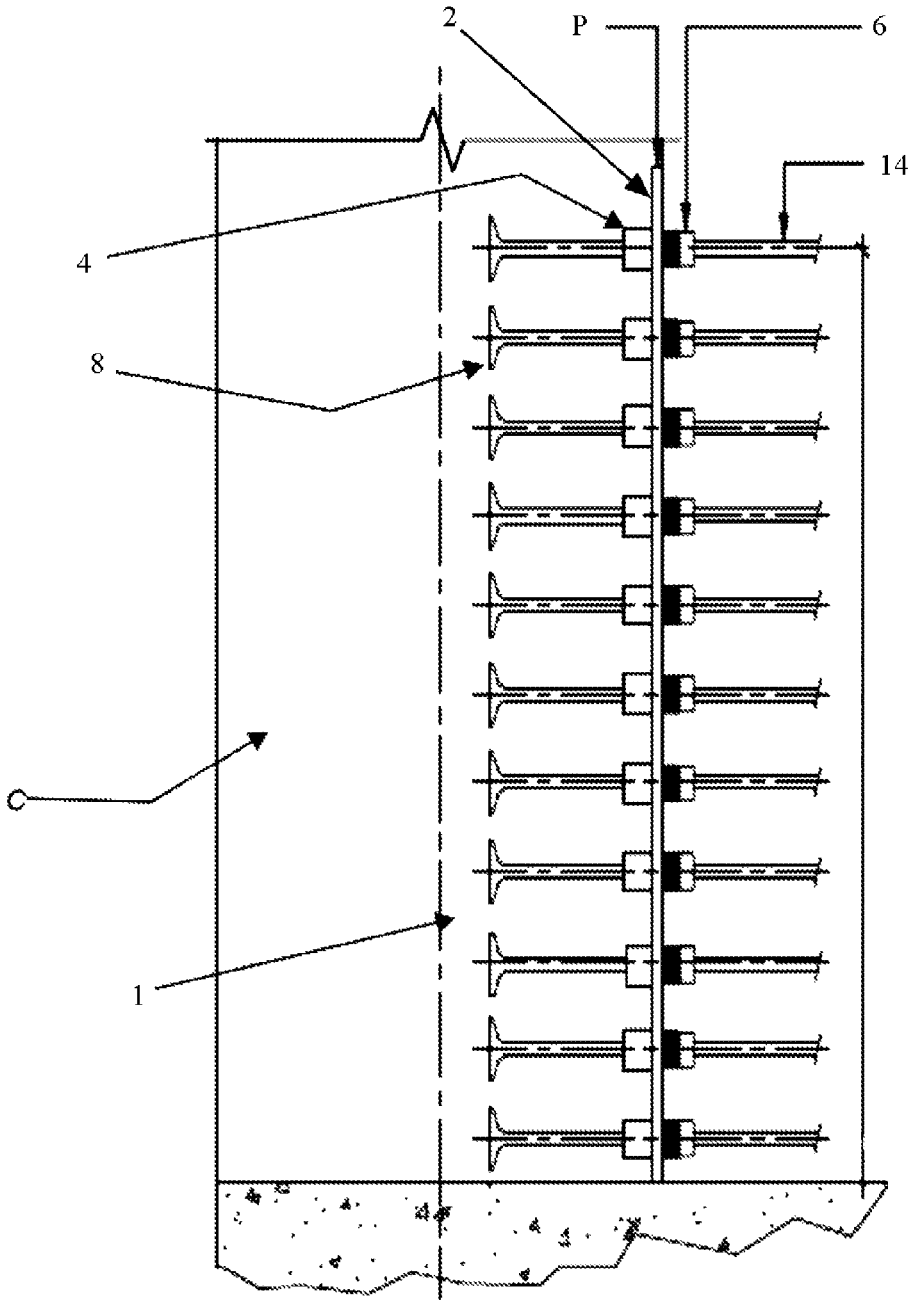
FIG. 3 is a sectional view of a multi-cable barrier anchorage embed according to the present invention.
Figure 5:
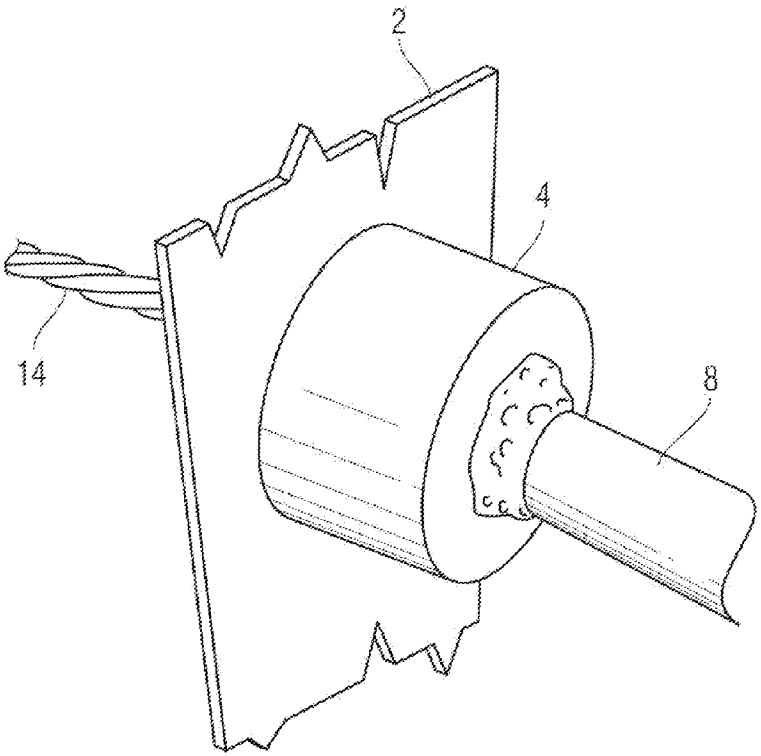
FIG. 5 is a backside view of a multi-cable barrier anchorage embed according to the present invention.

With reference to FIG. 3, a flat embed plate 2 sized to accommodate the requisite number of cable anchorages at the specified spacing is provided. Plate 2 is preferably galvanized steel for corrosion resistance and, in the depicted embodiment is an exemplary 48-inches in length by 4-inches wide to accommodate eleven (11) cables spaced on 4-inch centers leaving approximately 2-inches of plate margin above and below the topmost and bottommost cables. Plate 2 may be ¼-inch thick steel plate or flat bar such as for example A36 or 1018 that has been hot dip galvanized.

A series of holes at the desired anchorage locations are cut/drilled through the plate 2 in which to situate a plate cap 4 for each cable to be anchored. The holes are provided in a predetermined relative proximity to one another, such as on 4-inch centers, to meet building code or other design requirements. Relative proximity of each of the series of holes to one another is critical since accuracy of the location of holes in the plate member 2 will ultimately control spacing of the cables 14 relative to one another. The holes are also provided in a second predetermined relative proximity to a predefined point P along the edge of the plate, typically along the top or bottom edge. This second relative proximity is compared against an external datum such as a finished floor elevation to ensure proper positioning of the cable barrier within the concrete column C of the barrier structure for code compliance or other design requirements.

Figure 4:
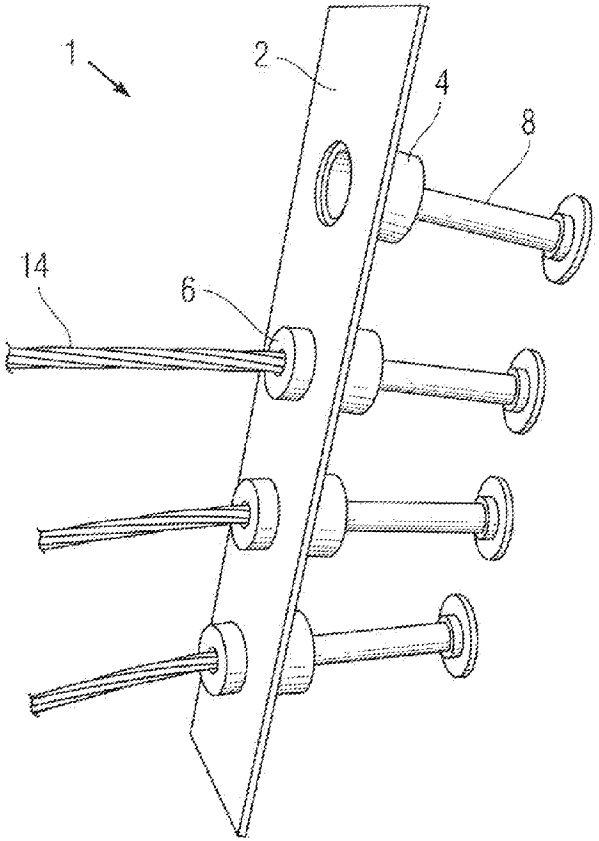
FIG. 4 is a partial perspective view of a multi-cable barrier anchorage embed according to the present invention.

As best seen in FIG. 4, the plate holes are sized to permit threaded barrel anchors 6 to pass through and into the plate caps 4 (as will be described), yet small enough to prevent the plate caps from passing. An internally threaded female-threaded plate cap 4 is welded to the back of the plate 2 at each hole location such that the internally threaded portion is accessible from the front side of the plate 2 through the hole. The plate caps 4 are generally cylindrically formed and are provided with an internally threaded void on one end of the cylinder, and a generally flat opposing end that is generally parallel to the back surface of the plate 2 where the plate cap 4 is welded within the hole. The plate cap 4 need only be tack welded within the hole.

Figure 10:
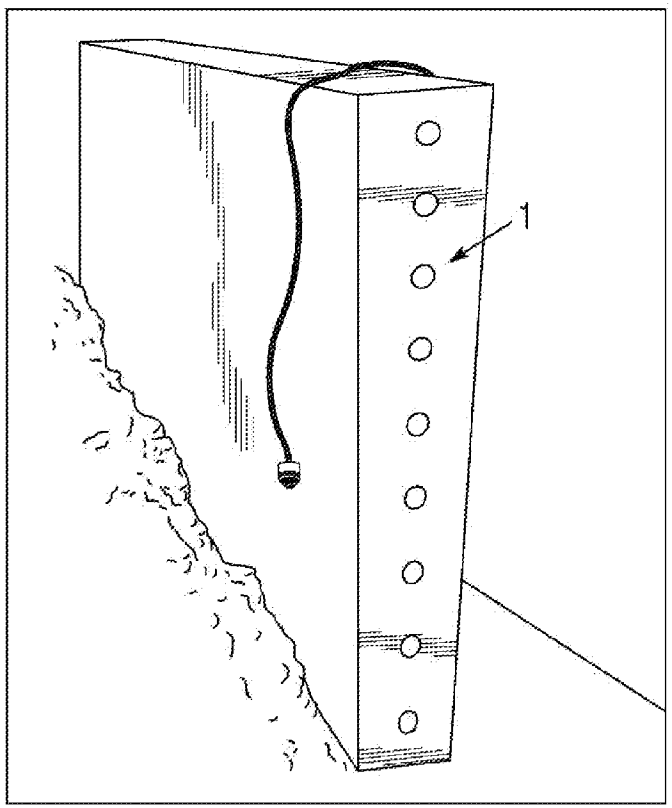
FIG. 10 is a perspective view of multi-cable barrier anchorage embed according to the present invention installed in a concrete wall prior to cable installation.
Figure 9:
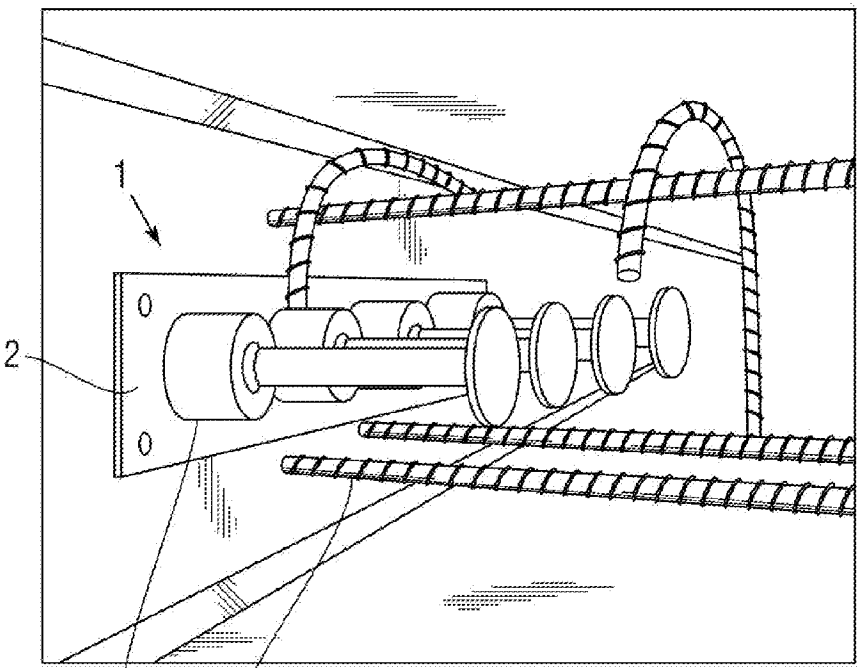
FIG. 9 is a top view of a multi-cable barrier anchorage embed according to the present invention installed in a concrete formwork.

A punching shear resistance (PSR) stud 8 is welded to each plate cap 4 opposite the threaded void and extends generally perpendicularly away from the embed plate 2. The PSR studs 8 may alternatively be integrally formed with the plate cap 4. PSR studs are large-headed shear connectors typically used for shear reinforcement in flat concrete slabs to replace stirrups and column capitals. PSR studs 8 resist the punching shear stress in the slabs and thereby reduce the amount of reinforcing steel required. Here, a single stud 8 is paired with each plate cap 4 to create an independent structural element within the larger plate assembly 1. By maintaining the structurally individualized nature of each cable anchor within the assembly, the system is able to ensure that each anchor is properly embedded within the concrete column C of the barrier column structure and each cable is able to achieve its full breaking strength in operation of the barrier. At the same time, labor costs of setting the anchors is reduced and the accuracy of their placement is increased by the plate member 2 which registers the multiple plate caps 4 relative to one another within the formwork (as seen in FIG. 9) and relative to an external datum such as the finished floor level (FIG. 10).

Figure 8:
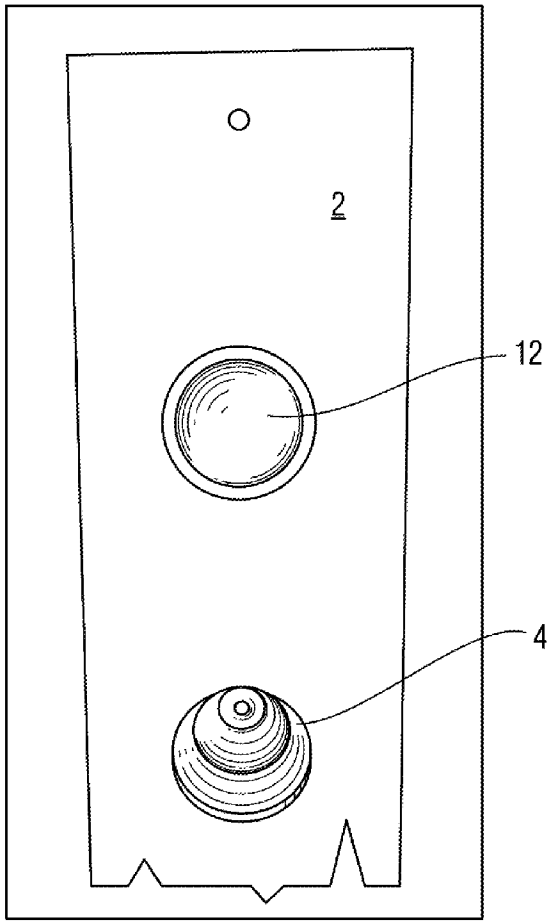
FIG. 8 is a partial front view of the plate member.

After sub-assembly of the embed system 1, a plastic plate cap insert 12 (FIG. 8) is placed into the hole in the flat plate from the front side to protect the open end of the plate cap 4 and prevent concrete from entering the threaded void during concrete placement. The above-described subassembly is shipped to the job site where it is attached to concrete formwork using nails, bolts or similar fasteners as seen in FIG. 9.

Figure 6:
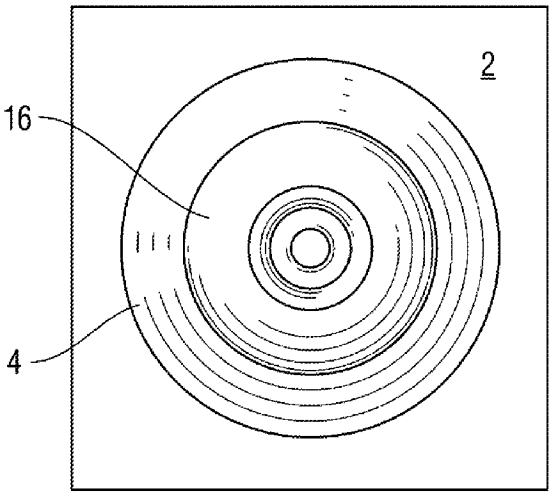
FIG. 6 is a front view of the plate member showing a rubber wedge spacer visible through a plate hole.
Figure 7:
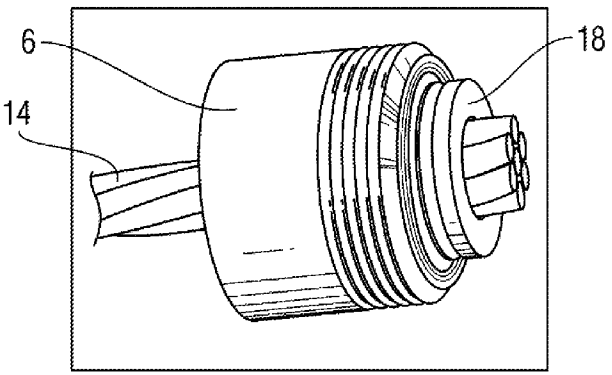
FIG. 7 is a side view of a cable engaged through a barrel anchor.

After concrete placement and form removal, the plastic plate cap insert 12 is removed and a rubber wedge spacer 16 is inserted into the plate cap 4 through the plate 2, as seen in FIG. 6. With additional reference to FIG. 7, the electroplated machined male threaded barrel anchor 6 with a conventional three-piece wedge anchor 18 (a three-section slotted cone) pre-installed in the conical barrel is threaded into the cooperatively threaded plate cap 4. The cable 14 is then inserted through the electroplated machined male threaded barrel anchor 6 and three-piece wedge anchor 18 until it bottomsout against the inside of the plate cap 4. The cable 14 can then be back-set against the exposed end of the electroplated machined male threaded barrel anchor 6 seating the three-piece wedge anchor 18 within the barrel anchor 6 and securing the cable 14. The cable can then be tensioned from its opposing end. Each plate cap 4 anchors a single cable and is securely affixed to and within the concrete structure by the attached PSR stud 8, properly positioned by the plate 2.

The above-described method of and apparatus permits placement of multiple cables individually anchored by a single embedded plate cap 4, and aligns the individual barrier cable anchors within the concrete structure so as to be secured in desired relative proximity and capable of withstanding pullout forces to the full breaking strength of the barrier cable.

The above-described embodiment is for the purpose of promoting an understanding of the principles of the invention. It should nevertheless be understood that no limitation of the scope of the invention is thereby intended, such alternations and further modifications in the illustrated device, and such further applications of the principles of the invention as illustrated herein being contemplated as would normally occur to one skilled in the art to which the invention relates.

We claim:

1. A method of securing a plurality of individual barrier cable anchors within a concrete structure, comprising the steps of:

providing a plate member having a front surface defining a front side and a back surface defining a back side;

providing a plurality of holes through said plate member extending from said front surface to said back surface, said plurality of holes positioned in a first predetermined relative proximity to one another and in a second predetermined relative proximity to a reference point at an edge of said plate member;

securing a plurality of plate caps to said back surface of said plate member, said plurality of plate caps each comprising a solid member having an internal aperture defined by an internally threaded portion, each of said plurality of plate caps being attached to the back surface of said plate member with said internal aperture aligned with one of said plurality of holes and said internally threaded portion operatively accessible from said front side of said plate member;

securing a punching shear resistor (PSR) stud to each of said plurality of plate caps on said back side of said plate member;

affixing said plate member with secured plate caps and PSR studs within a concrete formwork such that said back surface of said plate member is in direct contact with said concrete formwork with said plate caps and said PSR studs extending into said concrete formwork and said reference point at the edge of said plate member is positioned in a third predetermined relative proximity to an external datum;

pouring concrete into said concrete formwork;

curing said concrete;

removing said concrete formwork;

securing a barrier cable to each of said plurality of plate caps, said step of securing a barrier cable comprising for each of said plurality of plate caps the substeps of, threading a barrel anchor through one of said plurality of holes in said plate member and into said internally threaded portion of said internal aperture of each of said plurality of plate caps, inserting a wedge element into each of said plurality of plate caps, inserting said barrier cable through each said barrel anchor; and tensioning said barrier cable against said barrel anchor, whereby each said wedge element is seated in each said barrel anchor thereby securing said barrier cable to the plate cap in which said wedge element is seated;

whereby each said cable is anchored to said concrete structure in said first predetermined relative proximity to one another and in a fourth predetermined relative proximity to said external datum.

2. A method for attaching a plurality of barrier cables to a concrete structure, comprising the steps of:

providing a plate member having a front side, a backside, and a linear array of equally-spaced holes formed there through;

securing a plurality of plate caps to said backside of said plate member, each of said plurality of plate caps comprising a solid member having an internal aperture defined by an internally threaded portion, each of said plurality of plate caps being secured within one hole of said linear array of holes with said internal aperture aligned with said one hole;

securing a plurality of punching shear resistor (PSR) studs one each to one of said plurality of plate caps on said backside of said plate member;

establishing a first reference point on a concrete formwork;

mounting said plate member on said concrete formwork a first predetermined distance from said first reference point, the backside of said plate member facing said concrete formwork;

pouring concrete into said formwork;

curing said concrete;

removing said formwork;

inserting a plurality of barrel anchors onto a plurality of barrier cables, each of said plurality of barrel anchors comprising a solid member having an externally threaded portion;

inserting a plurality of wedge anchors one each onto one of said plurality of barrier cables and seating inside one of said plurality of barrel anchors;

screw threading each of said plurality of barrel anchors into one of said plurality of plate caps to secure said barrier cable to said plate member; and tensioning each of said plurality of barrier cables.

3. The method for attaching a plurality of barrier cables to a concrete structure according to claim 2, wherein said step of providing a plate member further comprises the substeps of:

establishing a second reference point on said plate member; and forming the linear array of equally-spaced holes in said plate member at a second predetermined distance from said second reference point.

4. The method for attaching a plurality of barrier cables to a concrete structure according to claim 2, wherein said step of mounting said plate member on said concrete formwork a first predetermined distance from said first reference point comprises mounting said plate member 4-inches apart on center from said first reference point on said concrete formwork.

5. The method for attaching a plurality of barrier cables to a concrete structure according to claim 2, wherein said step of securing a plurality of plate caps to said backside of said plate member comprises securing a plurality of internally-female-threaded plate caps.

6. The method for attaching a plurality of barrier cables to a concrete structure according to claim 2, wherein said step of providing a plate member further comprises the substeps of:

establishing a third reference point at an edge of said plate member; and providing said linear array of equally-spaced holes at a third predetermined distance from said third reference point.

7. The method for attaching a plurality of barrier cables to a concrete structure according to claim 2, further comprising a step of welding each of said plurality of plate caps to said plate member.

8. The method for attaching a plurality of barrier cables to a concrete structure according to claim 7, further comprising a step of welding each of said plurality of PSR studs to one of said plurality of plate caps.

* * * * *